US006431052B1

(12) United States Patent
Kim

(10) Patent No.: US 6,431,052 B1
(45) Date of Patent: Aug. 13, 2002

(54) POWER GENERATING APPARATUS USING COMPRESSED AIR

(75) Inventor: Young-Chan Kim, 1 Kamiimadacho, Saiin, Ukyo-Ku, Kyoto 615-0001 (JP)

(73) Assignee: Young-Chan Kim, Kyoto (JP)

( * ) Notice: Subject to any disclaimer, the term of this patent is extended or adjusted under 35 U.S.C. 154(b) by 0 days.

(21) Appl. No.: 09/845,424

(22) Filed: Apr. 30, 2001

(30) Foreign Application Priority Data

Jan. 5, 2001 (KR) ..... 2001-601

(51) Int. Cl.[7] ..... F01B 1/00; F16H 21/44

(52) U.S. Cl. ..... 92/72; 92/92; 74/102; 74/143

(58) Field of Search ..... 92/72, 76, 89, 92/90, 91, 92, 140; 74/102, 142, 143

(56) References Cited

U.S. PATENT DOCUMENTS 253,515 A * 2/1882 Croft, Jr. ..... 74/143
1,419,331 A * 6/1922 Veenschoten ..... 92/92 X
1,659,034 A * 2/1928 Linderman ..... 92/92 X
3,911,754 A * 10/1975 Pitto ..... 74/102
4,220,006 A 9/1980 Kindt
4,416,954 A 11/1983 Zaromb
5,279,209 A * 1/1994 Mayne ..... 92/140
5,373,759 A * 12/1994 Sergan ..... 74/143 X

* cited by examiner

*Primary Examiner*—John E. Ryznic
(74) *Attorney, Agent, or Firm*—Eugene Lieberstein; Michael N. Meller; Anderson Kill & Olick

(57) ABSTRACT

Provided is a power generating apparatus for obtaining a desired power source from elastic movement of an elastic tube into which compressed air is injected. The elastic pressure receptacle having compressed air is rotatably supported and pistons engaged with the elastic receptacle are installed in the vicinity thereof. Also, installed is a driving mechanism having circular plates having inclined protrusions for providing power to rotate the elastic pressure receptacle while inducing elastic movement for driving the pistons from the elastic pressure receptacle and a seesaw mechanism having rollers in contact with the inclined protrusions of the circular plate. The rotation power generated from the elastic pressure receptacle can be used as a desired power source through a driving shaft integrally installed on the elastic pressure receptacle.

5 Claims, 5 Drawing Sheets

POWER GENERATING APPARATUS USING COMPRESSED AIR

BACKGROUND OF THE INVENTION

1. Field of the Invention

The present invention relates to a power generating apparatus using compressed air, and more particularly, to a power generating apparatus using compressed air, adapted to easily obtain desired power from elastic movement of a tube having compressed air.

2. Description of the Related Art

In general, an apparatus for generating power burns fuel filled inside an engine to operate pistons with explosive power generated when the fuel is burned, and to rotate a shaft through a connecting rod and a crank, thereby obtaining rotation power. The power generating apparatus requires power, and an engine must withstand high temperature and high pressure to burn the fuel. Also, since a high-temperature heat is generated inside the engine, a cooling apparatus for cooling the engine is necessary. Another power generating apparatus includes a motor using electrical energy. In order to continuously utilize the power generating apparatus, the electrical energy must be continuously supplied. Thus, when electricity supply is interrupted due to power failure, the power generating apparatus cannot be used.

SUMMARY OF THE INVENTION

To solve the above problems, it is an object of the present invention to provide a power generating apparatus using compressed air, adapted to obtain a stable, economic power source from elastic movement of a tube having compressed air.

To accomplish the above object of the present invention, there is provided a power generating apparatus using compressed air including an elastic pressure receptacle for accommodating compressed air to have an elastic force in a radial direction, a protective receptacle, fixedly rotatably installed, having piston holes surrounding and protecting the elastic pressure receptacle and radially formed, pistons, inserted into the piston holes to be movably installed radially, subjecting to a force from the elastic pressure receptacle in a radial direction, a first circular plate, fixedly installed in the vicinity of the protective receptacle, having first inclined projections formed at the outer circumference at a predetermined angular distance, a second circular plate, fixedly installed and spaced a predetermined distance aparat from the first circular plate, having second inclined projections formed at the outer circumference at a predetermined angular distance, a seesaw mechanism, installed so as to be capable of seesawing around a predetermined support point, one end of which is connected to the pistons, and having first and second rollers contacting the first and second inclined projections, respectively, at the other end, and a rotation shaft, connected to the protective receptacle, rotating together when the protective receptacle rotates.

The second inclined projection of the second circular plate preferably projects more outwardly than the first inclined projection of the first circular plate, and the outer circumference of the first and second inclined projections are preferably inclined by a predetermined angle lengthwise with respect to the seesaw mechanism.

Also, the power generating apparatus may further include a compressed air supply tank, connected in communication with the elastic pressure receptacle, for supplying compressed air.

The first and second rollers are preferably formed of magnets.

Further, the power generating apparatus may further include a housing having air flow holes and surrounding the power generating apparatus, for rotatably supporting the protective receptacle and the rotation shaft, wherein a compressed air spray for spraying the compressed air toward the seesaw mechanism.

Therefore, according to the present invention, a stable, economic power source can be obtained.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

A preferred embodiment of the present invention will now be described in detail with reference to the accompanying drawings scribed in detail with reference to the accompanying drawings.

Figure 1:
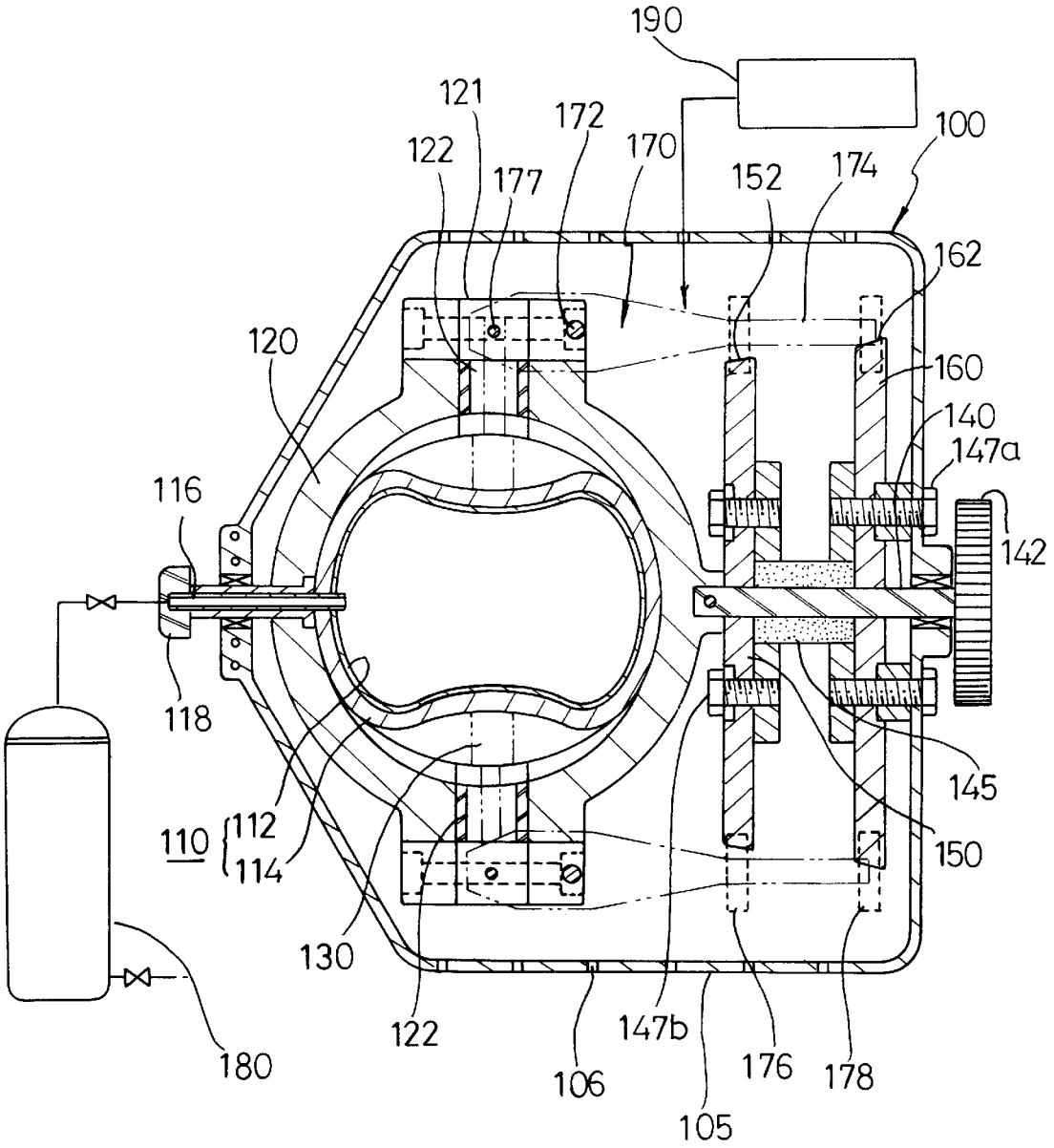
FIG. 1 is a cross-sectional view illustrating the internal structure of a power generating apparatus using compressed air according to the present invention.
Figure 2:
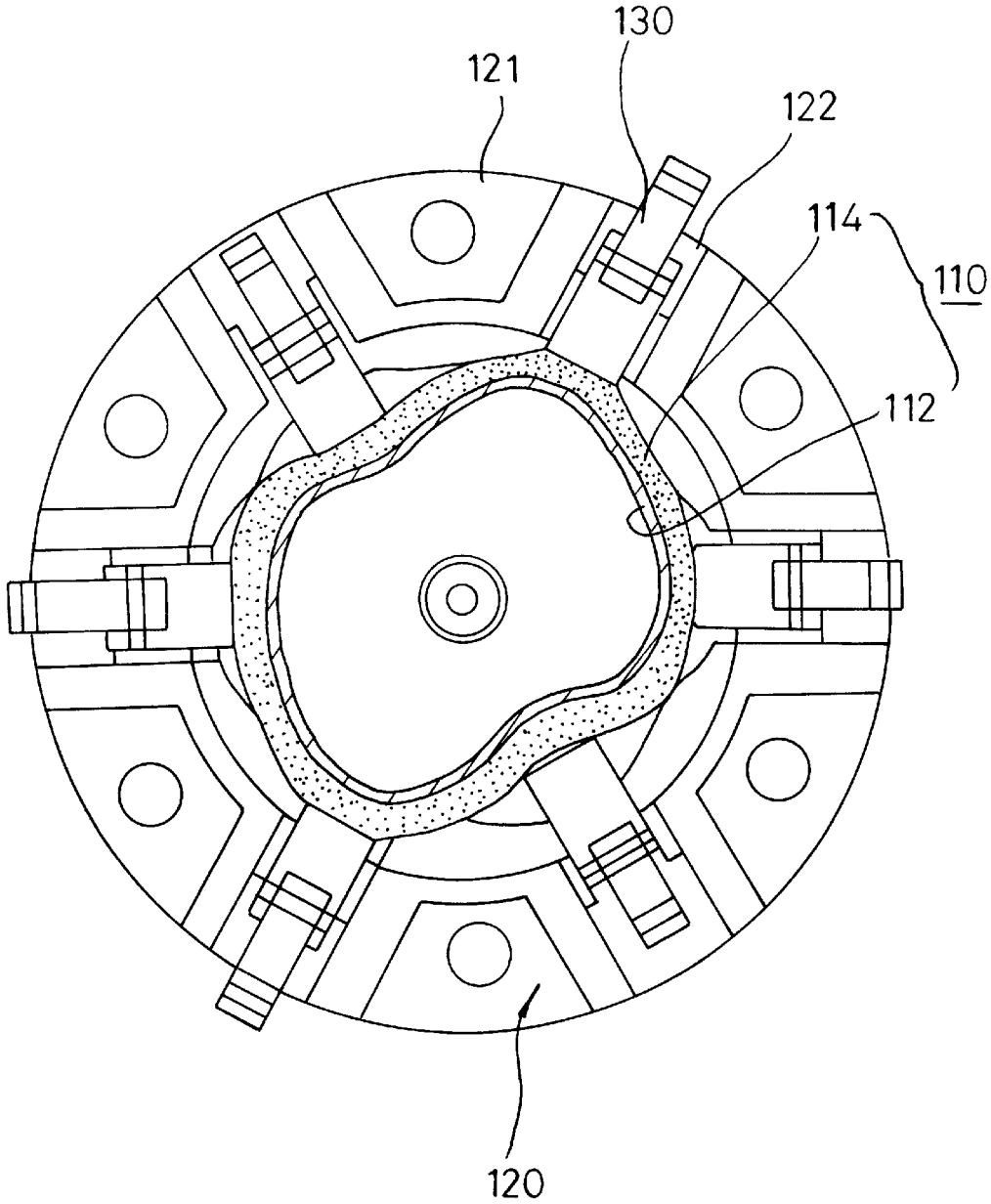
FIG. 2 illustrates the installation state of pistons shown in FIG. 1.

FIG. 1 is a cross-sectional view for explaining the internal structure of a rotation power generating mechanism using compressed air according to the present invention, and FIG. 2 illustrates the installation state of a piston.

As shown in FIGS. 1 and 2, a power generating apparatus 100 using compressed air according to the present invention includes a pressure receptacle 110 capable of elastic movement. The elastic pressure receptacle 110 includes a spherical tube 112 dilating or contracting by directly injected compressed air, and a tire 114 surrounding to protect the outside of the tube 112. The elastic pressure receptacle 110 can be replaced with another container having a function similar to that of the tube 112 and tire 114.

An air injection tube 116 for injecting compressed air into the elastic pressure receptacle 110, is installed at one side of the elastic pressure receptacle 110. Also, a cap 118, for preventing the compressed air from draining out, is detachably coupled to the end of the elastic pressure receptacle 110. A general air compressor, for refilling the inside of the elastic pressure receptacle 110 with compressed air, may be connected to the air injection tube 116. In this embodiment of the present invention, a compressed air tank 180 in which compressed air supplied from an air compressor is stored is illustrated by way of example. When the inside of the elastic pressure receptacle 110 is filled with compressed air, the elastic pressure receptacle 110 is elastically contracted or dilated in a radial direction.

A protection receptacle 120, installed outside the elastic pressure receptacle 110, accommodates the elastic pressure receptacle 110 therein to protect the same. Also, there is provided a piston cover 121 having a centrally formed piston hole 122 at left and right sides of the elastic pressure receptacle 110, to provide a path for allowing a piston 130 to move. The piston holes 122 are radially disposed. The protection receptacle 120 is protected by a housing 105. The protection receptacle 120 is axially supported to the housing 105 so as to be rotatable by the integrally formed air injection tube 116 and a rotation shaft 140 to be described later. An air flow hole 106 that allows air circulation, is preferably formed in the housing 105, which will later be described in detail.

As shown in FIG. 2, the piston 130 is inserted into each of the piston holes 122 so that one end thereof contacts the elastic pressure receptacle 110 to be engaged therewith and the other end is linked with a seesaw mechanism 170 to be described later by means of a pin 177. Thus, when the elastic pressure receptacle 110 is pressed from a one-end piston 130 by a force generated by the seesaw mechanism 170, the elastic pressure receptacle 110 elastically moves in the opposite direction to push the other-end piston 130 disposed at the opposite side of the one-end piston 130. Then, the pistons 130 directly in contact with the elastic pressure receptacle 110, are subjected to a force that thrusts outwardly, that is, radially, by the elastic force of the elastic pressure receptacle 110, and the piston 130 performs an interlocking action of pushing the seesaw mechanism 170 connected through the pin 177.

As shown in the drawing, the power generating apparatus 100 using compressed air according to the present invention includes the rotation shaft 140. The rotation shaft 140, integrally coupled to the protection receptacle 120 to be rotatably supported to the housing 105, is so constructed that it rotates together with the protection receptacle 120 with a supporting point of the housing 105. A power transmitting member, e.g., a gear 142, for transmitting rotation power to other parts, is installed at the exterior end of the rotation shaft 140. Any means that can transmit power, may be used instead of the gear 142 shown in the drawing. A first circular plate 150 and a second circular plate 160, spaced a predetermined distance apart from each other, are coupled to the outer circumferences of the rotation shaft 140. The first and second circular plates 150 and 160 are integrally connected on the rotation shaft 140 by means of a connector 145 connected by bolts 147*a* and 147*b*. The first and second circular plates 150 and 160 include a first inclined projection 152 and a second inclined projection 162 formed at a predetermined angle along the edges of the first and second circular plates 150 and 160, respectively, which will later be described in more detail with reference to FIG. 4. The outer circumferences of the first and second inclined projections 152 and 162 are preferably inclined at a predetermined angle in a direction of the rotation shaft.

Also, the power generating apparatus 100 includes the seesaw mechanism 170. The seesaw mechanism 170 is configured to obtain rotation power by the first and second circular plates 150 and 160 while seesawing with a phase difference using the force of the pistons 130 moved by the elastic pressure receptacle 110. The seesaw mechanism 170 is installed so as to seesaw about a supporting pin 172 installed at one side of the protection receptacle 120, and has seesaw members 174 each connected to the pistons 130 by the pin 177, at either end. A first roller 176 is installed in the seesaw member 174. The first roller 176, rotatably installed in the vicinity of the first circular plate 150, presses a relatively gentle (right side) inclined plane of the first inclined projection 152 of the first circular plate 150 at a location in a predetermined angle range along the seesaw motion of the seesaw member 174, thereby obtaining rotation power in one direction by a fractional force generated at the inclined plane.

Also, a second roller 178 having the same diameter as the first roller 176, is installed at a location spaced apart from the first roller 176, that is, at one end of the seesaw member 174. The second roller 178, rotatably installed in the vicinity of the second circular plate 160, lifts the support pin 172 using one end of the seesaw member 174 as a supporting point, while being applied to a force outwardly by the second inclined projection 162 of the second circular plate 160. The second roller 178, installed farther from the rotation center of the seesaw member 174 than the first roller 176, easily lifts one end of the seesaw member 174 with a relatively lesser force. The second roller 178 ascends along a relatively gentle (left side) inclined plane of the second inclined projection 162 (see FIG. 4). Here, the first and second rollers 176 and 178 are preferably constructed of magnetic bodies for faster and stronger driving.

The power generating apparatus 100 using compressed air, includes a compressed air spray 190 for compensating for rotatary movement by spraying the compressed air in a direction tangential to the rotation of the seesaw member 174. As the compressed air spray 190, a means for generating compressed air, e.g., air compressor, may be used. In some cases, another types of rotation force supplementing means, e.g., means using wind or water, may be used. Also, in other cases, the rotation force may be supplemented by spraying air continuously or intermittently. The air flow hole 106 is formed in the housing 105 by the compressed air spray 190.

Figure 3:
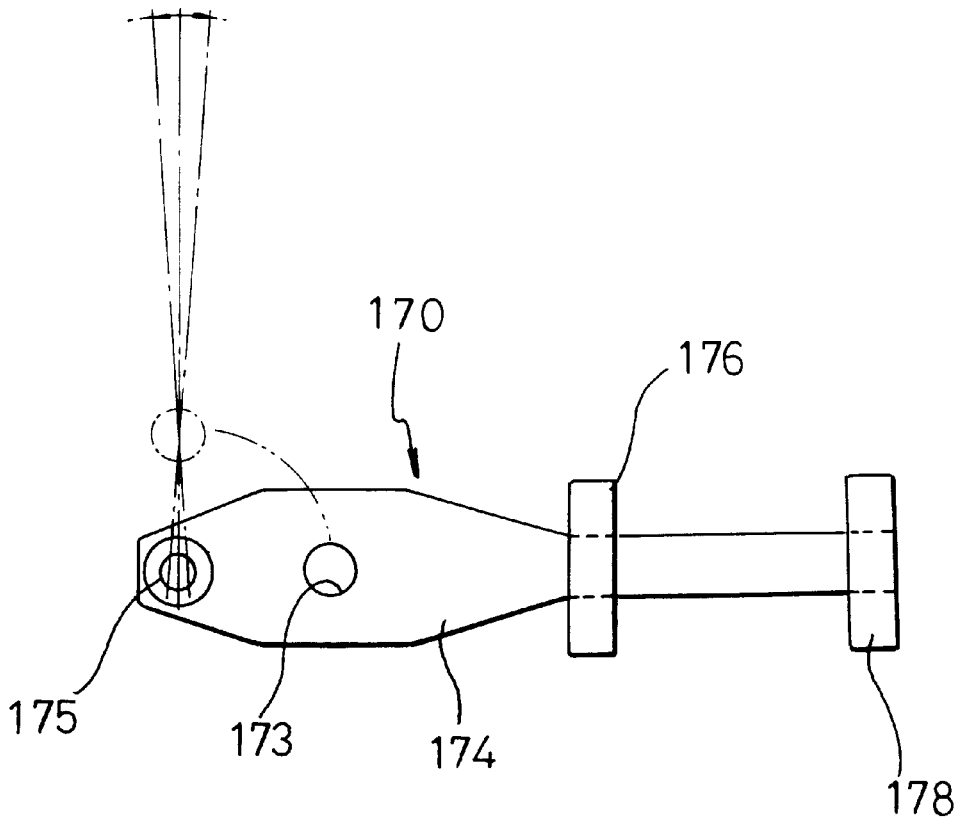
FIG. 3 is a side view of a seesaw mechanism connected to the pistons shown in FIG. 1.
Figure 4:
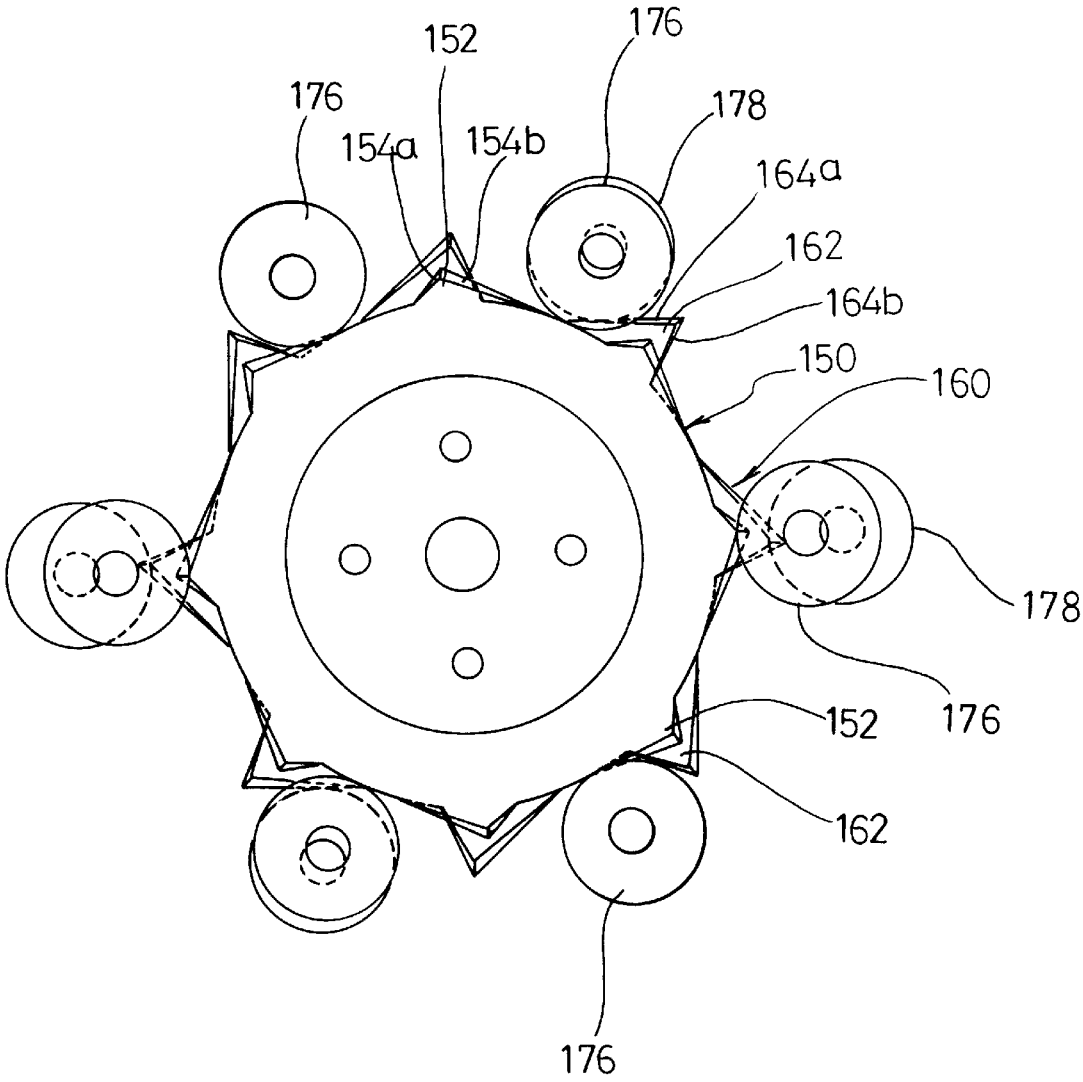
FIG. 4 is a front view illustrating the arrangement of first and second disks and first and second rollers.
Figure 5:
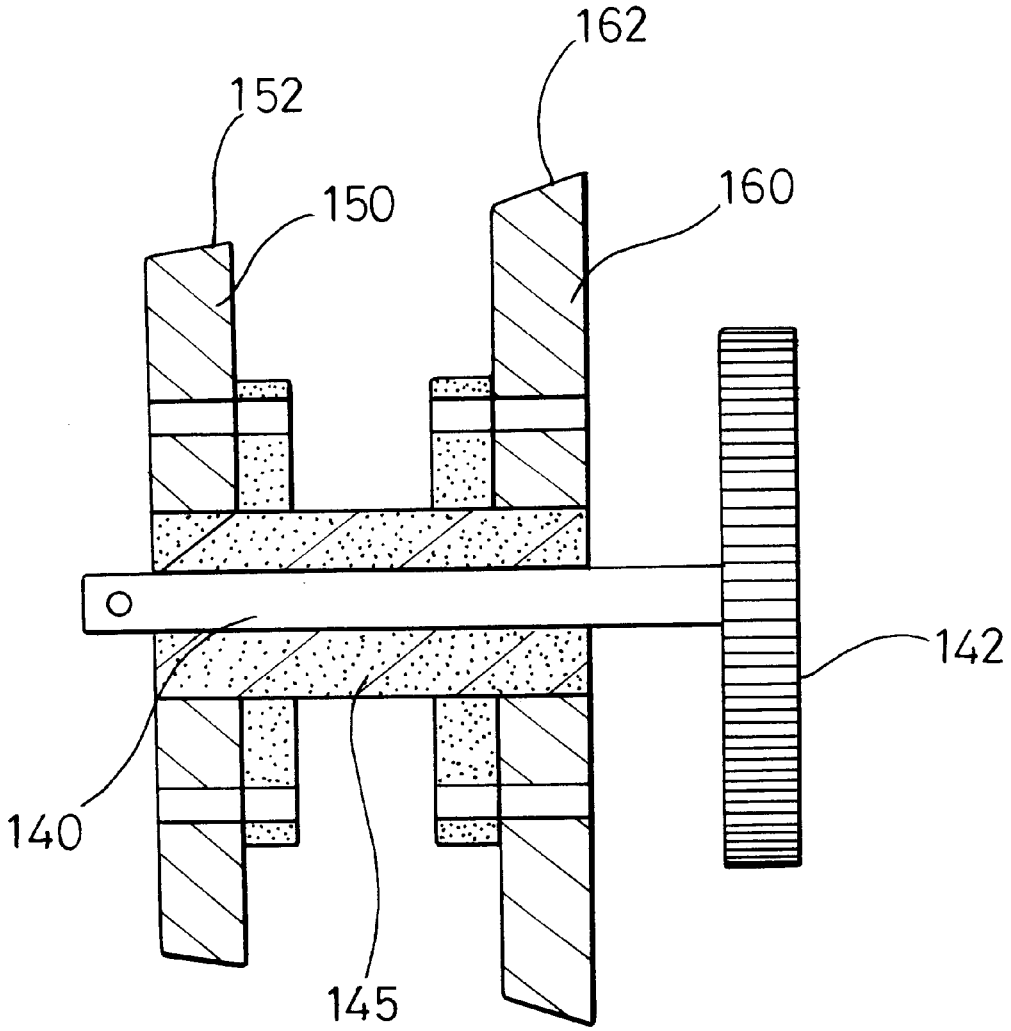
FIG. 5 is a side sectional view illustrating the installation state of the first and second disks and a rotary shaft shown in FIG. 1.

FIG. 3 is a side view showing the seesaw mechanism coupled to the piston, FIG. 4 is a front view showing the state in which the first and second circular plates and the first and second rollers are arranged, and FIG. 5 is a lateral cross-sectional view showing the state in which the first and second circular plates and a rotation shaft are installed.

As shown in FIG. 3, the seesaw mechanism 170 includes the seesaw member 174 having a predetermined length, to which the pistons 130 shown in FIG. 2 are connected, and, the first roller 176 and the second roller 178, spaced a predetermined distance apart from each other. At one side of the seesaw member 174 are provided the support hole 173 for rotatably supporting the seesaw member 174 to the protective receptacle 120 by means of the support pin 172 (see FIG. 1), and a connection hole 174 for installing the pin 177 (see FIG. 1) to be connected to the pistons 130. Thus, the seesaw member 174 performs seesaw movement around the support hole 173.

As shown in FIGS. 4 and 5, the first circular plate 150 and the second circular plate 160 are integrally connected to each other through the connector 145 to then be fixed to the housing 105 by means of bolts 147*b* in such a state. The first inclined projection 152 formed on the first circular plate 150 and the second circular plate 162 formed on the second circular plate 160 are inclined in the direction of the rotation shaft. The reason of the foregoing will now be briefly described. In a state in which the seesaw member 174 is rotated by a predetermined angle, the contact plane of the first and second rollers 176 and 178 is also inclined at a predetermined angle. Thus, in order to attain smooth contact, the contact plane between the first inclined projection 152 and the second inclined projection 162 is also inclined lengthwise with respect to the outer circumference.

The rotation shaft 140, freely rotable inside the connector 145, is coupled inside the connector 145. Since the interior end of the rotation shaft 140 is fixed to the protective receptacle 120, when the protective receptacle 120 rotates, the rotation shaft 140 integrally connected to the protective receptacle 120 and the air injection tube 116 rotate together using the housing 105 as a supporting point. A gear 142 for transmitting rotation power to another necessary parts, is connected to the rotation shaft 140. Alternative power transmitting means such as pulley may be installed instead of the gear 142.

As shown in FIG. 4, a plurality of first inclined projections 152 having inclined planes 154*a* and 154*b* are formed along the periphery of the first circular plate 150 at a predetermined angular distance. A plurality of second inclined projections 162 having inclined planes 164*a* and 164*b* are formed along the periphery of the second circular plate 160, spaced a predetermined distance apart from the first circular plate 150, at a predetermined angular distance. The right inclined plane 154*b* of the first inclined projection 152 is formed more gently than the left inclined plane 154*a* thereof. Thus, when the first roller 176 is positioned on the left inclined plane 154*a,* the second roller 178 is in a state in which it ascends along the left inclined plane 164*a* of the second inclined projection 162. Thus, the first roller 176 is out of contact with the left inclined plane 154*a* of the first inclined projection 152.

In such a state, the first roller 176 comes into contact with the right inclined plane 154*b* of the first inclined plane 152 from the time when the first roller 176 and the second roller 178 reach the vertex of the first inclined projection 152 and the second inclined projection 162, thereby attaining its rotation force. On the other hand, the second roller 178 is brought out of contact from the second inclined projection 162 from the time when it reaches the vertex of the second inclined projection 162, so that it is brought out of contact from the right inclined plane 164*b* of the second inclined projection 162. In order to allow the above-described procedure to occur, it is necessary to appropriately determine the inclination angles of the inclined planes 154*a* and 154*b* and 164*a* and 164*b*. In other words, as shown in FIG. 4, the right inclined plane 154*b* of the first inclined projection 152 is formed more gently than the left inclined plane 154*a*. Also, the right inclined plane 164*b* of the second inclined projection 162 is formed more sharply than the left inclined plane 164*a*. Also, the first roller 176 must have each inclined planes so that it can be spaced apart from the inclined projection 152 while the second roller 178 ascends along the left inclined plane 164*a* of the second inclined projection 162. The second roller 178 must have each inclined planes so that it can be spaced apart from the right inclined plane 164*b* of the second inclined projection 162 while the first roller 176 contacts the right inclined plane 154*a* of the first inclined projection 152.

If air is injected from the compressed air storage tank 180 into the inside of the elastic pressure receptacle 110, the pressure inside the tube 112 increases so that the tube 112 expands. Accordingly, the tire 114 disposed outside the tube 112 also expands to pull the pistons 130 outwardly. Since a plurality of pistons 130, as shown in FIG. 2, are radially arranged, the tube 112 and the tire 114 outside the tube 112 pull away the pistons 130 subjected to lesser resistance. Thus, the seesaw member 174 whose one end is connected to the pistons 130, is rotated around the support pin 172, and the first roller 176, installed at the other end of the seesaw member 174, strongly presses the right inclined plane 164*b* of the first inclined projection 152.

Since the first circular plate 150 and the second circular plate 160 are fixed to the case 105, the first roller 176 is applied to a rotation force clockwise, and the rotation force is transferred to the protective receptacle 120 via the seesaw member 174, so that the seesaw mechanism 170 installed around the protective receptacle 120 rotates clockwise and the rotation shaft 140 integrally connected to the protective receptacle 120 also rotates.

The second roller 178, installed at the end of the seesaw member 174, rotates along the periphery of the second circular plate 160, to come into contact with the right inclined plane 164*b* of the second inclined projection 162, thereby subjecting to a force outwardly. Accordingly, while the end of the second roller 178 of the seesaw member 174 is lifted using the support pin 172 as a supporting point, the piston 130 installed opposite to the second roller 178 descends from the seesaw member 174 using the support pin 172 as a supporting point, to thus strongly press the elastic pressure receptacle 110. Here, since the second roller 178 is positioned farther from the rotation center of the seesaw member 174, that is, the support pin 172, than the first roller 176, it can lift one end of the seesaw member 174 with a relatively less force. Another seesaw member 174 between the seesaw members 174 performs the intermediate operation.

As described above, if the piston 130 strongly presses the elastic pressure receptacle 110 while it descends using the support pin 172 as a support point, the force is applied in the opposite direction, thereby facilitating to push the opposed piston 130 outwardly. As described above, the repetitive operation of the pistons 130 and the geared seesaw mechanism 170 makes it possible to continuously obtain necessary power such that the protective receptacle 120 connected with the seesaw mechanism 170 and the rotation shaft 140 are continuously rotated.

During the above-described procedure, in order to prevent power balance from energy loss due to friction among various elements, it is preferable to supply compressed air from the compressed air spray 190 continuously or intermittently in the direction tangential to the rotating seesaw member 174.

As described above, an economic and stable power source can be obtained by the power generating apparatus using compressed air according to the present invention.

What is claimed is:

1. A power generating apparatus using compressed air comprising:

an elastic pressure receptacle for accommodating compressed air to have an elastic force in a radial direction;

a protective receptacle, fixedly rotatably installed, having piston holes surrounding and protecting the elastic pressure receptacle and radially formed;

pistons, inserted into the piston holes to be movably installed radially, subjecting to a force from the elastic pressure receptacle in a radial direction;

a first circular plate, fixedly installed in the vicinity of the protective receptacle, having first inclined projections formed at the outer circumference at a predetermined angular distance;

a second circular plate, fixedly installed and spaced a predetermined distance aparat from the first circular plate, having second inclined projections formed at the outer circumference at a predetermined angular distance;

a seesaw mechanism, installed so as to be capable of seesawing around a predetermined support point, one end of which is connected to the pistons, and having first and second rollers contacting the first and second inclined projections, respectively, at the other end; and a rotation shaft, connected to the protective receptacle, rotating together when the protective receptacle rotates.

2. The power generating apparatus according to claim 1, wherein the second inclined projection of the second circular plate projects more outwardly than the first inclined projection of the first circular plate, and the outer circumference of the first and second inclined projections are inclined by a predetermined angle lengthwise with respect to the seesaw mechanism.

3. The power generating apparatus according to claim 1, further comprising a compressed air supply tank, connected in communication with the elastic pressure receptacle, for supplying compressed air.

4. The power generating apparatus according to claim 1, wherein the first and second rollers are formed of magnets.

5. The power generating apparatus according to claim 1, further comprising a housing having air flow holes and surrounding the power generating apparatus, for rotatably supporting the protective receptacle and the rotation shaft, wherein a compressed air spray for spraying the compressed air toward the seesaw mechanism.

* * * * *